United States Patent [19]

Hayashi et al.

[11] Patent Number: 4,934,848

[45] Date of Patent: Jun. 19, 1990

[54] PRINTER HEAD WITH ADJUSTABLE MAGNETIC RELUCTANCE

[75] Inventors: Mikio Hayashi; Yuichi Yamakawa, both of Tokyo, Japan

[73] Assignee: Seikosha Co., Ltd., Japan

[21] Appl. No.: 78,236

[22] Filed: Jul. 27, 1987

[30] Foreign Application Priority Data

Jul. 28, 1986 [JP] Japan ..... 61-177312

[51] Int. Cl.[5] ..... B41J 3/02

[52] U.S. Cl. ..... 400/124; 400/157.2; 101/93.05; 101/93.48; 335/237

[58] Field of Search ..... 400/124, 157.2; 101/93.04, 93.05, 93.48; 335/237

[56] References Cited

U.S. PATENT DOCUMENTS 885,688 4/1908 Cubitt ..... 335/237
936,503 10/1909 Williams ..... 335/237 X
1,632,609 6/1927 Lee ..... 335/237 X
2,282,933 5/1942 Cahill ..... 335/237
4,461,207 7/1984 Helinski ..... 335/237 X

FOREIGN PATENT DOCUMENTS 208066 12/1983 Japan ..... 400/124
162658 8/1985 Japan ..... 400/124

*Primary Examiner*—Eugene H. Eickholt
*Attorney, Agent, or Firm*—Bruce L. Adams; Van C. Wilks

[57] ABSTRACT

A printer head comprising a plurality of driving arms provided corresponding to a like plurality of printing elements and a like plurality of electromagnetic driving devices for driving the corresponding driving arms independently. Each of the electromagnetic driving devices includes a movable yoke fixed to a corresponding driving arm, a core piece facing the yoke and having a coil mounted around the core piece, and a magnet adjacent to the core piece. Each of the magnetic circuits includes an adjusting member for adjusting the magnetic reluctance thereof.

12 Claims, 3 Drawing Sheets

PRINTER HEAD WITH ADJUSTABLE MAGNETIC RELUCTANCE

BACKGROUND OF THE INVENTION

This invention relates to an impact type printer head.

A conventional printer head has a plurality of electromagnetic drive devices to drive drive arms corresponding to a plurality of printing elements which are required to have an uniform response characteristic or a uniform printing characteristic. To this end, in the prior art, the individual parts constituting the electromagnetic drive device must have high machining precision. Therefore, when drive arms are stamped out, they are each adjusted to eliminate its possible warp due to the stamping out. A movable yoke is then fixed to each of the drive arms, and the arms are bent forwardly a predetermined quantity under which condition all the yokes are then polished at their back end surfaces, and all the core pieces are polished so as to have a predetermined surface. These arms are adjusted with high precision so as to be uniform and are then assembled.

Another example is known in which a core opposite to a movable yoke is adapted to be moved by a screw structure, the spacing between the core and the movable yoke is adjusted to equalize the printing characteristic.

However, the above prior art requires high precision-finished parts which require skill to adjust and thereby render the manufacturing cost high. Recently, the number of printing elements have tended to increase gradually. Therefore, it is difficult to adjust all the printing elements with high precision to render the printing characteristics uniform, so that it will take much time and labor for adjustment. In the type in which adjustment is made by rotating the core, the core is required to be cylindrical, so that a coil mounted around this core is limited in shape to a cylinder. As the number of printing elements increases, miniaturization becomes very difficult.

It is therefore an object of this invention to provide a printer head in which the respective printing elements are easily capable of obtaining a uniform drive characteristic.

SUMMARY OF THE INVENTION

In order to achieve the above object, this invention provides a printer head comprising:

a plurality of driving arms provided corresponding to a like plurality of printing elements; and a like plurality of electromagnetic driving devices for driving the corresponding driving arms independently;

each of said electromagnetic driving devices including a movable yoke fixed to a corresponding driving arm, a core piece facing said yoke and having a coil mounted around said core piece, and a magnet adjacent to said core piece; and each of said magnetic circuits including means for adjusting the magnetic reluctance thereof.

BRIEF DESCRIPTION OF THE DRAWINGS

FIG. 3 is a cross-sectional view of the essential portion of one embodiment;

FIGS. 4 is a bottom view of the adjusting means of FIG. 3;

FIGS. 5 is a cross-sectional view of the essential portion of another embodiment;

FIG. 6 is a cross-sectional view taken along the line VI—VI of FIG. 5;

FIG. 7 is a cross-sectional view taken along the line VII—VII of FIG. 6; and FIGS. 8–11 are cross-sectional views of the essential portions of other embodiments.

DETAILED DESCRIPTION OF THE PREFERRED EMBODIMENTS

Figure 1:
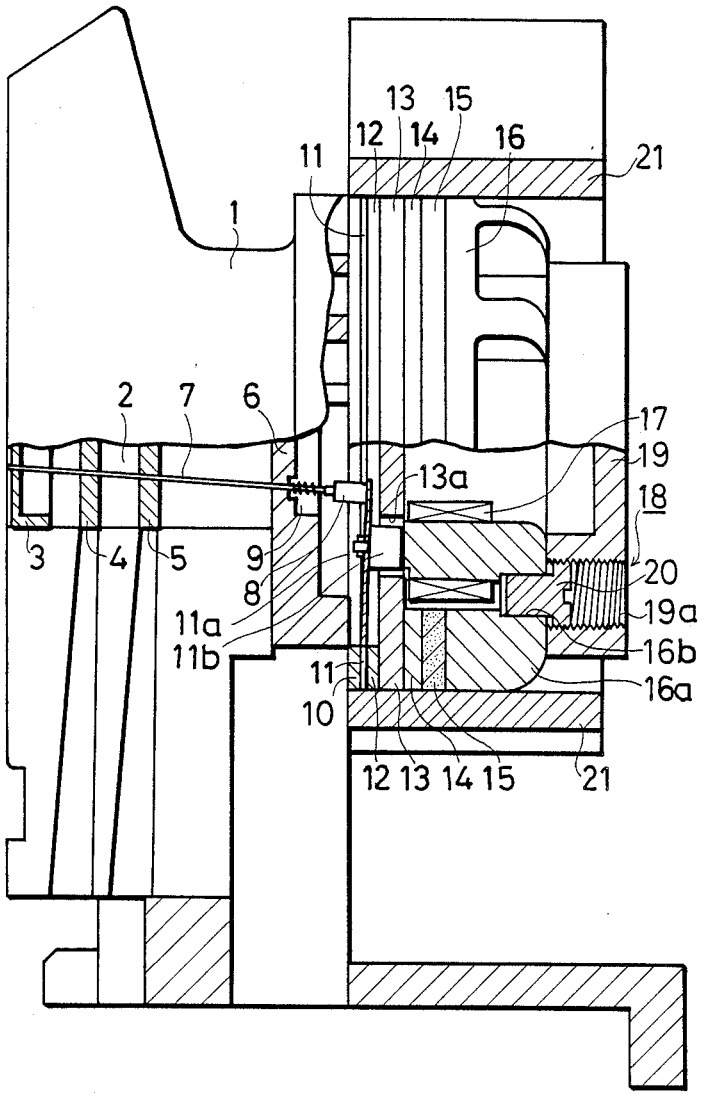
FIG. 1 is a lengthwise cross-sectional view of one embodiment of a printer head according to this invention, showing the internal structure thereof with a portion of the head being removed away.

One preferred embodiment of this invention will now be described with reference to the drawings. As shown in FIG. 1, a printer head mainly includes a printing wire assembly, a driving arm assembly, a core assembly and a coil assembly.

The printing wire assembly includes wire guides 3, 4, 5 fixed within a cavity 2 in a plastic head frame 1. A plurality of printing elements, each including a printing wire member 7, are supported slidably by the wire guides 3–5 and a head frame wall 6. Each printing wire member 7 has a printing pin 8 fixed to its rear end. A return spring 9 inserted between printing pin 8 and wall 6 biases a corresponding printing wire member 7 backwardly (to the right in FIG. 1).

The driving arm assembly positioned behind the printing wire assembly includes a stop plate 10 of a nonmagnetic material, a driving arm 11, a spacer 12, and a yoke plate 13 of a magnetic material. These elements are fixed by screws (not shown) in a layered manner and fixed by screws (not shown) to head frame 1. Driving arms 11 are disposed radially at equiangular intervals and connected a their backward ends integrally. Each driving arm has a hole 11*a* at its midpoint in which hole a movable yoke 11*b* of a magnetic material is fixed by a bond or the like. A yoke plate 13 has a through hole 13*a* through which movable yoke 11*b* extends movably.

The core assembly positioned behind the driving arm assembly includes an annular magnetic plate 14 of a magnetic material, a magnet 15, and a core 16 which includes an assembly of U-like core pieces 16*a* of a magnetic material. These elements are connected integrally as a unit by a bond. The entire core assembly is connected to the driving arm assembly by screws (not shown).

Figure 2:
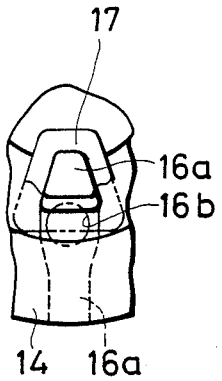
FIG. 2 is a front view of part of a core assembly of the head.

U-like core pieces 16*a* are positioned radially corresponding to the arranged driving arms 11, as shown in FIG. 2. The inner leg portions of the core pieces 16*a* take the form of a trapezoid in cross section to thereby increase the efficiency of the space between adjacent core piece. The front end surface of an inner core piece faces the corresponding rear end surface of movable yoke 11*b*. A driving coil 17 is mounted around the inner leg portion of a corresponding core piece 16*a*. Each driving coil 17 is held by a coil terminal block (not shown) to constitute the coil assembly.

A magnetic circuit of the electromagnetic driving device is constituted by movable yoke 11*b*, core piece 16*a* and magnet 15. Each magnetic circuit has a magnetic reluctance adjusting means 18. In more detail, each core piece 16*a* has a through hole 16*b*. A support plate 19 of a nonmagnetic material attached behind core 16 has a threaded hole 19*a* opposite to hole 16*b*. A threaded portion provided at the head of adjusting pin 20 of a magnetic material is screwed into threaded hole 19*a* so that adjusting pin 20 is movable in hole 16*b*. A heat radiator fin 21 is capped over the printer head.

The printer head has such structure, so that when adjusting pin 20 is rotated, the length of pin 20 inserted into through hole 16*b* changes continuously to thereby adjust the magnetic reluctance of the magnetic circuit. Therefore, after the printer head is assembled, the drawing force between a movable yoke 11*b* corresponding to each printing element 7 and corresponding core piece 16*a* is compared to the spring force of the corresponding driving arm 11. For an electromagnetic driving device in which the drawing force is greater than the corresponding spring force, the adjusting pin 20 is retracted to thereby increase the magnetic reluctance of the magnetic circuit to reduce the drawing force. On the other hand, for an electric magnetic driving device in which the drawing force is smaller than the corresponding spring force, the adjusting pin 20 is reversely advanced to thereby reduce the magnetic reluctance of the magnetic circuit to increase the drawing force. In this way, all the adjusting pins 20 of all electromagnetic drive devices are each moved back and forth to gain the equilibrium between the drawing force and the spring force to thereby render the rise up and printing characteristics of all the printing elements uniform.

Figure 3:
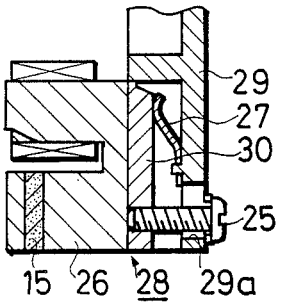
FIGS. 3–11 show various embodiments of magnetic adjustment means.
Figure 4:
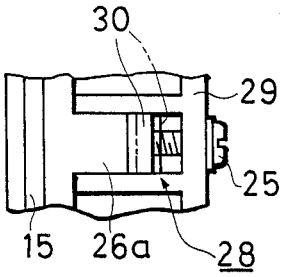

FIGS. 3–11 show various embodiments of the magnetic reluctance adjusting means. The magnetic reluctance adjusting means 28 shown in FIGS. 3 and 4 has a core piece 26*a* which has a slightly cut away back on which is disposed an adjusting plate 30 of a magnetic material which in turn is pressed toward the core by a support plate 29 of a nonmagnetic material and a press spring 27 fixed to the support plate 29. A spacing adjusting screw 25 is screwed at its end into adjusting plate 30 through a hole 29*a* in support plate 29. Since adjusting plate 30 is prevented from rotating by support plate 29, as shown in FIG. 4, rotation of screw 25 causes adjusting plate 30 to move toward or away from the back of core piece 26*a* right and left, as shown by the broken lines in FIG. 4, to thereby set the spacing between the core back and adjusting plate 30 to a desired value. A change in the spacing brings about a change in the magnetic reluctance of the magnetic circuit to thereby bring about uniform adjustment as in the above embodiment.

Figure 5:
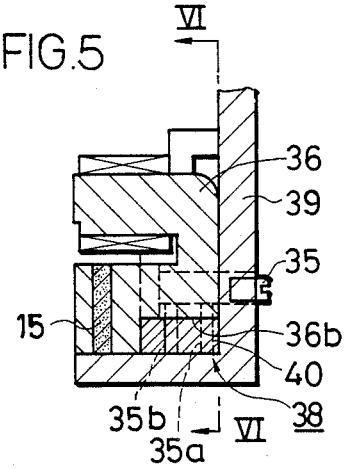
Figure 6:
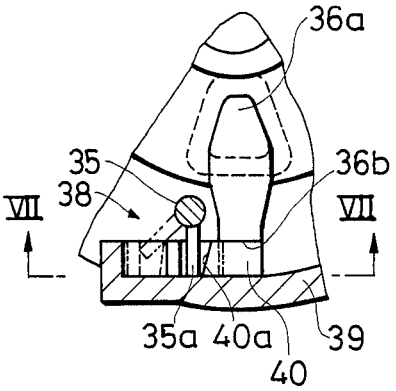
Figure 7:
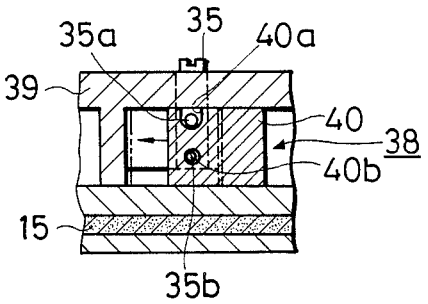

The magnetic reluctance adjusting means 38 shown in FIGS. 5–7 has a cutout 36*b* on the outer peripheral surface of core 36*a* in which cutout is disposed an adjusting member 40 of a magnetic material which is slidable across cutout 36*b* and supports an operating pole 35 rotatably in a support member 39 provided on the back of core piece 36*a*. Pole 35 has operating arms 35*a*, 35*b* extending therefrom which are received at one end in holes 40*a*, 40*b* in adjusting member 40. When operating pole 35 is rotated, operating arms 35*a*, 35*b* are swung as shown in FIG. 6 to thereby slide adjusting member 40 right and left, as shown in FIGS. 6, 7 because the arms 35*a*, 35*b* are received at their ends in holes 40*a*, 40*b*. This causes the area in which core piece 36*a* and adjusting member 40 face each other to change to thereby change the magnetic reluctance of the magnetic circuit to result in uniform adjustment as in the above embodiment.

Figure 8:
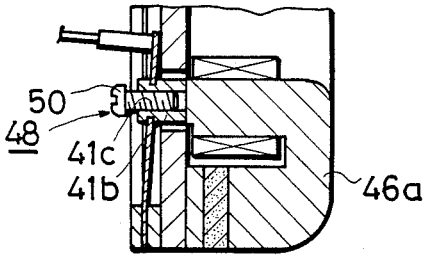

The magnetic reluctance adjusting means 48 shown in FIG. 8 has a movable yoke 41*b* opposite to core piece 46*a*, the yoke 46*b* having a threaded hole 41*c* in which is screwed an adjusting screw 50 of a magnetic material from the front side of the yoke. When screw 50 is rotated, the length of the screw inserted into hole 41*c* changes to thereby change the magnetic reluctance of the magnetic circuit to result in uniform adjustment as in the above embodiments.

Figure 9:
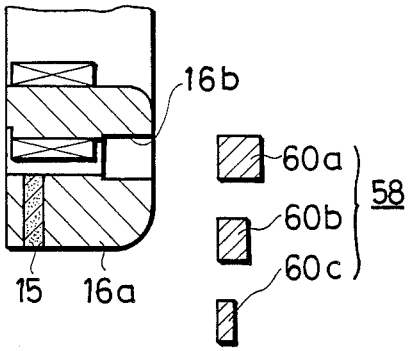

The magnetic reluctance adjusting means 58 shown in FIG. 9 has a plurality of reserve adjusting pins 60*a*, 60*b*, 60*c* different in thickness instead of pin 20 shown in FIG. 1 so that one of the pins can be selected to be inserted into hole 16*b* to change the magnetic reluctance of the magnetic circuit.

Figure 10:
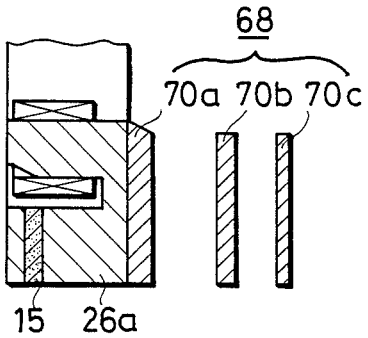

The magnetic reluctance adjusting means 68 shown in FIG. 10 has a plurality of reserve adjusting plates 70*a*, 70*b*, 70*c* in different in thickness instead of adjusting plates 30 shown in FIG. 3 so that one of the adjusting plates can be selected and glued to the back of core piece 26*a* as by a bond to change the magnetic reluctance of the magnetic circuit.

Figure 11:
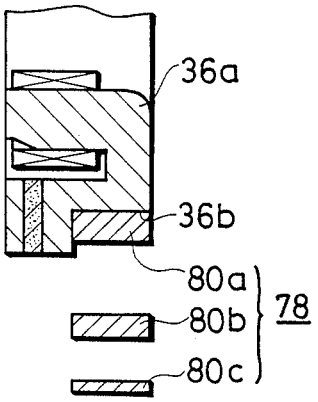

The magnetic reluctance adjusting means 78 shown in FIG. 11 has a plurality of reserve adjusting members 80*a*, 80*b*, 80*c* different in thickness instead of adjusting member 40 shown in FIG. 5 so that one of the members 80*a*, 80*b*, 80*c*, can be selected and glued into cutout 36*b* as by a bond to change magnetic reluctance of the magnetic circuit.

It is to be noted that in the embodiments of FIGS. 10 and 11, the adjusting plate or member may have a plurality of reserve adjusting plates or members having the same thickness so that the number of them can be selected to change the entire thickness of laminated adjusting plates or members.

As described above, according to this invention, the individual parts constituting each of the electromagnetic driving devices corresponding to a plurality of printing elements require no high machining precision and no high adjusting precision during assembly. After assembly the magnetic reluctance of the magnetic circuit can easily be adjusted by the magnetic reluctance adjusting means, thereby rendering the printing characteristics of all the printing elements uniform very easily. Thus as the printing elements increase in number, the advantage becomes remarkable.

What is claimed is:

1. A printer head comprising:

a plurality of printing elements and guide members slidably supporting the printing elements, a resilient plate member arranged behind the printing elements and having a plurality of resilient driving arms arranged radially and with each radially outer end connected to one another in a body and with each radially inner end contacting a rear end of one of the printing elements, electromagnetic driving means for independently driving the driving elements through the driving arms, the driving means being disposed behind the resilient plate member and having a plurality of U-shaped cores formed in a body and arranged radially in correspondence to the driving arms, a plurality of coils wound around radially inner leg pieces of the U-shaped core, permanent magnet disposed at radially outer leg pieces of the U-shaped cores, and a plurality of movable yokes secured to the driving arms opposite the radially inner leg pieces of the U-shaped cores, and a plurality of adjusting means for adjusting a magnetic reluctance of each of the U-shaped cores comprising means disposed at a rear portion of each U-shaped core for changing an area of a sectional plane of each U-shaped core.

2. A printer head as claimed in claim 1, wherein the adjusting means comprises a hole formed between the radially inner leg piece and the radially outer leg piece of each U-shaped core and an adjusting pin movably inserted in the hole, whereby the area of the sectional plane between the radially inner leg piece and the radially outer leg piece is changed by changing the amount of insertion of the adjusting pin in the hole.

3. A printer head as claimed in claim 1, wherein the adjusting means comprises a hole formed between the radially inner leg piece and the radially outer leg piece of each U-shaped core and a plurality of adjusting pieces each having a different thickness and each insertable into the hole, whereby the area of the sectional plane between the radially inner leg piece and the radially outer leg piece is changed by selecting at least one of adjusting pieces having a suitable thickness and inserting the selected adjusting pieces into the hole.

4. A printer head as claimed in claim 1, wherein the adjusting means comprises a plurality of adjusting plates each having a different thickness and joinable to a rear plane of the U-shaped cores, whereby the area of the sectional plane of the rear portion of the U-shaped cores is changed by selecting at least one of the adjusting plates having a suitable thickness and joining the selected adjusting plates to the rear plane of the U-shaped core.

5. A printer head as claimed in claim 1, wherein the adjusting means comprises a cutout formed in the rear portion of each U-shaped core and a plurality of adjusting pieces each attachable in the cutout and each having a different thickness, and whereby the area of the sectional plane of the rear portion of the U-shaped cores is changed by selecting at least one of the adjusting pieces having a suitable thickness and attaching the selected adjusting pieces in the cutout.

6. A printer head as claimed in claim 1, wherein the adjusting means comprises a cutout formed in the rear portion of each U-shaped core and an adjusting member slidably arranged in the cutout to overlap the cores to a varying extent, and whereby the area of the sectional plane of the U-shaped cores is changed by sliding the adjusting member and changing the area of overlap of the adjusting member to the corresponding cores.

7. A printer head comprising:

a plurality of printing elements each having a rear end; and electromagnetic driving means for independently driving each printing element at the rear end thereof comprising a plurality of radially disposed U-shaped cores each having a radial inner leg and a radially outer leg, a plurality of coils wound around the radially inner legs of the cores, a permanent magnet disposed at the radially outer leg of each core, a plurality of movable yokes opposite the radially inner leg for driving the printing elements, and means for adjusting the magnetic reluctance of each core comprising means disposed at a rear portion of each core for varying the area of a sectional plane of each core for determining the reluctance thereof.

8. The printer head as claimed in claim 7, wherein the means for varying comprises a hole disposed between the radially inner leg and the radially outer leg of the core and an adjusting pin movably inserted in the hole.

9. The printer head as claimed in claim 7, wherein the means for varying comprises a hole disposed between the radially inner leg and the radially outer leg of the each core, and a set of adjusting pieces each having a different thickness and each insertable into the hole.

10. The printer head as claimed in claim 7, wherein the means for varying comprises a set of adjusting plates each having a different thickness and attachable to the rear portion of each core.

11. The printer head as claimed in claim 7, wherein the means for varying comprises a cutout in the rear portion of each core, and a set of adjusting pieces each having a different thickness and attachable in the cutout.

12. The printer head as claimed in claim 7, wherein the means for varying comprises a cutout in a rear portion of each core, and an adjusting member slidably disposed in the cutout to vary the amount of overlapping between the core and the adjusting member.

* * * * *